US010518853B2

(12) United States Patent
Cuesta Zavala

(10) Patent No.: US 10,518,853 B2
(45) Date of Patent: Dec. 31, 2019

(54) COLLAR LIFE PRESERVER FOR WATER SPORTS

(71) Applicant: Ignacio Cuesta Zavala, Madrid (ES)

(72) Inventor: Ignacio Cuesta Zavala, Madrid (ES)

( * ) Notice: Subject to any disclaimer, the term of this patent is extended or adjusted under 35 U.S.C. 154(b) by 0 days.

(21) Appl. No.: 15/624,713

(22) Filed: Jun. 16, 2017

(65) Prior Publication Data

US 2018/0362128 A1 Dec. 20, 2018

(51) Int. Cl.

| | |
|---|---|
| ***B63C 9/20*** | (2006.01) |
| ***B63C 9/15*** | (2006.01) |
| *B63C 9/13* | (2006.01) |

(52) U.S. Cl.

CPC ..... *B63C 9/155* (2013.01); *B63C 9/20* (2013.01); *B63C 2009/133* (2013.01)

(58) Field of Classification Search

CPC ..... B63C 9/155; B63C 9/20

See application file for complete search history.

(56) References Cited

U.S. PATENT DOCUMENTS

| | | | | |
|---|---|---|---|---|
| 2003/0101998 | A1* | 6/2003 | Zocca | A61M 16/044 128/207.15 |
| 2010/0218964 | A1* | 9/2010 | Galloway | B25C 1/04 173/46 |
| 2011/0294382 | A1* | 12/2011 | Puls | B63C 9/0005 441/89 |
| 2012/0217263 | A1* | 8/2012 | Becnel | B63C 9/19 222/5 |
| 2015/0209621 | A1* | 7/2015 | Cason | A63B 33/00 2/68 |
| 2015/0289920 | A1* | 10/2015 | Burnett | A61B 18/02 606/24 |

* cited by examiner

*Primary Examiner* — Stephen P Avila

(57) ABSTRACT

This invention reveals a collar life preserver for water sports or similar that includes a compressed inflatable life preserver (1), a cartridge (2) that is filled with CO2, a solenoid valve (3) in connection with the cartridge (2), a discharge valve (4), a sensor (5) associated with a microprocessor (6) programmed with an algorithm and emission/reception means between the valve (3) and the microprocessor (6). The inflatable collar (1) presents a sensor (5) associated with the microprocessor (6) programmed with an algorithm that constantly receives information of the user's body functions and is capable of determining when the user is unconscious.

4 Claims, 1 Drawing Sheet

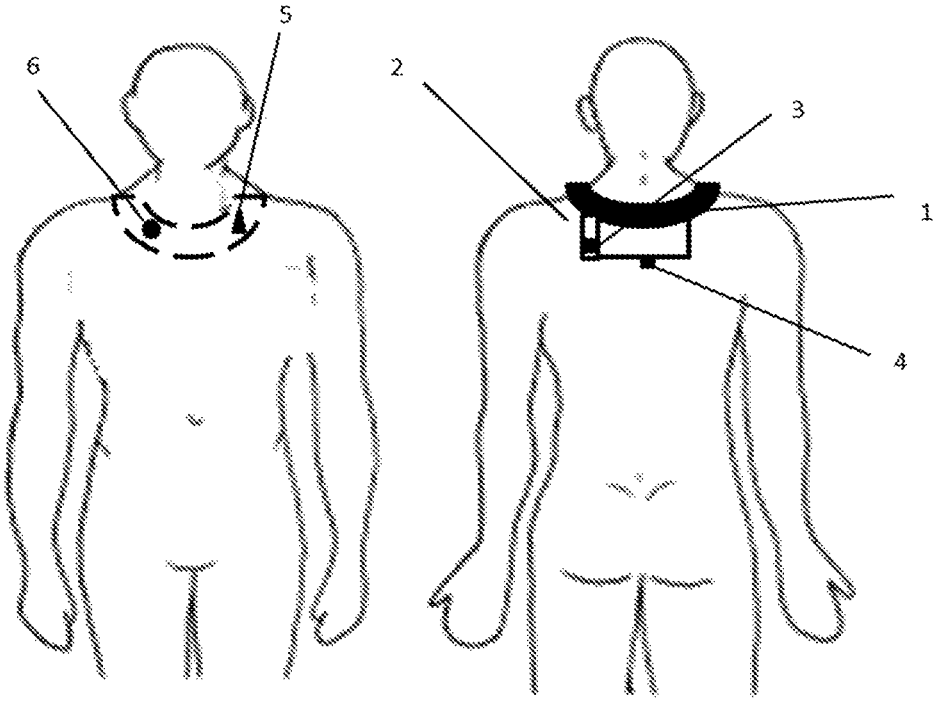
6
5
2
3
1
4

COLLAR LIFE PRESERVER FOR WATER SPORTS

PURPOSE OF THE INVENTION

This invention reveals a device similar to a collar composed internally by a compressed inflatable life preserver (1), in which the collar is placed around the user's neck and it can be inflated by means of a cartridge (2) full of CO2. The inflatable life preserver (1) features a sensor (5) associated with a microprocessor (6) programmed with an algorithm that constantly receives information of the user's body functions and is capable of determining when the user is unconscious, causing the CO2 cartridge to inflate the life preserve and maintain the head of the unconscious user in a safe position.

BACKGROUND OF THE INVENTION

The practice of aquatic sports, especially surfing, involves genuine risks and generates a considerable number of accidents. In general, the accidents are related to the loss of consciousness. The loss of consciousness is sudden and the surfer does not realise the danger.

Among the known protection elements in the marine area are the life preserver jackets that can be inflated by blowing through a small tube or pulling on a cord that activates a CO2 cartridge. This type of jackets keeps the head of the subject out of the water, even when unconscious. There are evolutions in this type of jackets which can be inflated automatically when coming in contact with the water. However, the problem that these jackets present is that for practicing a sport such as surfing, it is very complicated for the user to wear a jacket due to the fact that they are voluminous devices, uncomfortable to adjust and they reduce the surfer's mobility at all times.

A good solution is that put forward in this invention, which could be a collar-type life preserver which does not reduce the user's mobility and protects him in moments of danger.

The first inflatable collar-type flotation system, without interior bladder, was introduced in 1961 by the French company Fenzy. It was constructed of rubberised fabric, and the seams were sealed with glue. Another distinctive characteristic was the fact that it held a small bottle of compressed air that was refilled from the bottle. The air passed from the small bottle to the collar, through a small valve, which inflated the collar and converted it in a small reserve of extra air. In order to release the content of the air inside the collar, the user would use the manual inflating/deflating nozzle.

One of the main risks in practicing marine and submarine sports is fainting or loss of consciousness due to a lack of oxygen in the body, producing death by drowning. The athlete falls asleep without realising it while he remain under water, or he faints while going up to the surface, when he has exceeded his capacity of apnea and he lacks of oxygen, in these cases a life preserve is needed that is activated without the need of the user being awake, in other words, it activates automatically and independently of the user; it also needs to make the user's head float thanks to the body's centre of gravity.

Another predecessor is shown in U.S. Pat. No. 7,699,679 which reveals an inflatable swimming garment used as a life preserver for a swimmer, which includes an inflatable part so that the swimmer can float when he is in danger and to create, which it inflates, a difference of volume between the upper and lower parts of the swimmer's body. The garment includes an inflating system that consists of gas tank of compressed gas to inflate the inflatable part of the device when it is necessary; a controllable valve that connects between the air tank and the inflatable part, to allow, when necessary, the compressed gas to inflate the inflatable part; a controller to analyse the state of the swimmer under water and to open the valve after the swimmer has been in a real and imminent danger during a predetermined time; and a battery to supply energy for the functioning of the controller and the valve.

The cited "device" is only designed as a safety system for the practice of scuba diving in apnea or underwater fishing by snorkelling; in no case should it be used for autonomous scuba diving with bottles due to the risk of blow-up and excessive lung expansion.

The problem that this type of life preserver presents is that it does not ensure that the user's head is held out of the water at all times, since part of a life preserver garment does not ensure that the user's head is oriented properly.

In the device referred to above as background information, its sensor starts with a timer that begins to count when the swimmer is under the water in order to then send a signal so that the life preserver inflates, not taking into account other important variables such as the level of oxygen in the blood, the altered heart rate, etc.

DESCRIPTION OF THE DRAWINGS

In order to complement the description that is being made and with the aim of aiding a better understanding of the characteristics of the invention, as a preferred example of its practical realisation, a set of drawings is included as an integral part of this description, in which is included but not limited to the following:

FIG. 1. Sample of a front and back view of the device placed around the user's neck identifying the placement of the parts.

PREFERRED REALISATION OF THE INVENTION

The device of this invention starts with a collar composed internally by a compressed inflatable life preserver (1), where the collar is placed around the user's neck and it can be inflated by means of a cartridge (2) that if filled with CO2, with this cartridge (2) being capable of being changed when it has been used, that is, it can be recharged.

The inflatable life preserver (1) presents a solenoid valve (3) in connection with the cartridge (2) that allows its filling; in addition, the inflatable collar (1) presents a discharge valve (4) that permits emptying the inflatable collar (1) after its use.

The inflatable collar (1) presents a sensor (5) associated with a microprocessor (6) programmed with an algorithm that constantly receives information on the user's body functions and is capable, through predetermined values, of knowing when the user is unconscious.

The device has emission/reception means between the valve (3) and the microprocessor (6), with this sensor (5) being able to send a signal that alters the threshold of the predetermined value and the microprocessor (6) to send a signal to the solenoid valve (3) of the cartridge (2) of CO2 for the automatic filling, in such a way that this device keeps the user's head out of the water at the time in which the life preserver is used and, therefore, breathing can be maintained if the user is unconscious.

The device is susceptible of presenting a cord to activate the cartridge of CO2 manually in case of need.

The device also has a rechargeable battery that keeps the electronic elements in operation.

The microprocessor (6), programmed with the predetermined algorithm, detects by means of the sensor (5) an altered signal of the information obtain and sends a signal for the opening of the solenoid valve (3) for the activation of the cartridge (2).

It should be noted that the sensor (5) includes a pulse oximeter that detects a low level of oxygen saturation in the blood, a cardiac sensor that detects an altered heart rate, a sensor that captures muscle contractions, a movement sensor, in addition to a depth sensor for athletes that practice water sports, in particular, surfing.

One of the most important sensors that the device has is a sensor capable of sending external radio signals capable of being captured by life guards or emergency services when the unconsciousness of the user is detected.

The collar life preserver of this invention can also be used as an alternative for other sports where there is no specific protection, such as underwater fishing or else for children or persons with little mobility, being an alternative that provides safety for the user.

In another embodiment of the invention the CO2 cartridge can be replaced by any other means of gas generation, for example decompression of a solid by heat Having sufficiently described the nature of the invention, as well as the way using it in practice, it should be noted that the devices previously indicated and represented in the attached drawings are susceptible to modifications in details as long as they do not alter their fundamental principles, established in the previous paragraphs and summarised in the following claims.

The invention claimed is:

1. Collar life preserver for water sports that include a compressed inflatable life preserver (1), a cartridge (2) that is filled with CO2, a solenoid valve (3) in connection with the cartridge (2), a discharge valve (4), a sensor (5) associated with a microprocessor (6) programmed with an algorithm and emission/reception means between the valve (3) and the microprocessor (6), where the cartridge (2) can be recharged after each use, the sensor (5) associated with the microprocessor (6) is programmed with an algorithm that constantly receives information of the user's body functions and by means of predetermined values knows when the user is unconscious, the microprocessor (6) sends a signal to the solenoid valve (3) of the CO2 cartridge (2) for its automatic filling and there is a cord to manually activate the CO2 cartridge; wherein the sensor (5) includes

- a pulse oximeter that detects a low level of oxygen saturation in the blood,
- a cardiac sensor that detects an altered heart rate,
- a movement sensor and a sensor that captures muscle contractions.

2. The collar life preserver according to claim 1, in which the sensor (5) includes a depth sensor.

3. The collar life preserver according to claim 1 where the sensor (5) includes a sensor capable of sending external radio signals capable of being captured by life guards or emergency services.

4. The collar life preserver according to claim 1 where the CO2 cartridge can be replaced by any other means of gas generation, for example decompression of a solid by heat.

* * * * *